US009173475B2

(12) United States Patent
Blechman

(10) Patent No.: US 9,173,475 B2
(45) **Date of Patent: *Nov. 3, 2015**

(54) TOOL HOLDER WITH GUIDE PLATE FOR MOUNTING TOOLS HAVING SPRING CLIPS

(76) Inventor: Peter Blechman, Port Washington, NY (US)

( * ) Notice: Subject to any disclaimer, the term of this patent is extended or adjusted under 35 U.S.C. 154(b) by 1284 days.

This patent is subject to a terminal disclaimer.

(21) Appl. No.: 12/130,274

(22) Filed: May 30, 2008

(65) Prior Publication Data

US 2008/0302845 A1 Dec. 11, 2008

Related U.S. Application Data

(63) Continuation-in-part of application No. 11/748,683, filed on May 15, 2007, now abandoned, which is a continuation of application No. 10/734,360, filed on Dec. 12, 2003, now Pat. No. 7,216,788.

(60) Provisional application No. 60/435,435, filed on Dec. 20, 2002.

(51) Int. Cl.
*A45F 5/02* (2006.01)
*B25H 3/00* (2006.01)

(52) U.S. Cl.
CPC *A45F 5/02* (2013.01); *B25H 3/006* (2013.01); *A45F 5/021* (2013.01); *A45F 2200/0575* (2013.01)

(58) Field of Classification Search
USPC ..... 224/660–684, 904
See application file for complete search history.

(56) References Cited

U.S. PATENT DOCUMENTS

| | | | | |
|---|---|---|---|---|
| 882,178 | A | 3/1908 | Sloat | 24/13 |
| 3,516,585 | A | 6/1970 | Inwood | 224/584 |
| 4,598,027 | A * | 7/1986 | Johnson | 428/542.8 |
| 4,619,020 | A | 10/1986 | Lecher, Sr. | 24/10 A |
| 4,690,316 | A * | 9/1987 | Peterson | 224/674 |
| 4,746,042 | A | 5/1988 | King | 224/148.2 |
| 4,757,927 | A | 7/1988 | Rutty | 224/253 |
| 4,819,847 | A | 4/1989 | Anderson | 224/252 |
| 5,025,966 | A | 6/1991 | Potter | 224/183 |
| 5,054,672 | A * | 10/1991 | Weissman | 224/666 |
| 5,100,037 | A | 3/1992 | Kopyta et al. | 224/245 |
| 5,388,741 | A | 2/1995 | Hillinger | 224/253 |
| 5,452,830 | A | 9/1995 | Hopkins et al. | 224/252 |
| 5,511,705 | A | 4/1996 | Dreszer | 224/252 |
| 5,551,613 | A | 9/1996 | Malinowski | 224/666 |
| D388,955 | S | 1/1998 | Markiewicz | D3/228 |
| 5,826,762 | A | 10/1998 | Dellinger | 224/270 |
| 5,915,610 | A * | 6/1999 | Russell | 224/673 |
| 6,318,610 | B1 | 11/2001 | Doherty | 224/271 |
| 7,216,788 | B2 * | 5/2007 | Blechman | 224/162 |
| 2002/0014507 | A1 | 2/2002 | Snider et al. | 224/671 |
| 2006/0261116 | A1 * | 11/2006 | Brandeis | 224/671 |
| 2008/0105721 | A1 * | 5/2008 | Har-Shen | 224/667 |

* cited by examiner

*Primary Examiner* — Justin Larson
(74) *Attorney, Agent, or Firm* — Frank V. DeRosa, Esq.

(57) ABSTRACT

Tool holder devices are provided, which are designed to hold tools having spring clip mechanisms. In one aspect, a tool holder device comprises a guiding portion and a mounting portion. The mounting portion is adapted to engage a spring clip of a tool for mounting the tool. The guiding portion is adapted to guide a spring clip towards the mounting portion as a person slides the tool from the guiding portion to the mounting portion while maintaining contact between the spring clip and the guiding portion.

15 Claims, 7 Drawing Sheets

TOOL HOLDER WITH GUIDE PLATE FOR MOUNTING TOOLS HAVING SPRING CLIPS

CROSS-REFERENCE TO RELATED APPLICATION

This application is a Continuation-in-Part of U.S. patent application Ser. No. 11/748,683, filed May 15, 2007, now abandoned which is a Continuation of U.S. patent application Ser. No. 10/734,360, filed on Dec. 12, 2003, which is now U.S. Pat. No. 7,216,788, which claims priority to U.S. Provisional Application Ser. No. 60/435,435, filed on Dec. 20, 2002, which are all incorporated herein by reference.

TECHNICAL FIELD

The present invention relates generally to tool holders for holding tools having spring clips, such as tape measures. More specifically, exemplary embodiments of the invention include tool holders having rigid guiding plates, which enable an individual to slideably engage and disengage tools (e.g., a tape measure with a spring clip) on the holder with overwhelming ease.

BACKGROUND

Carpenters and other tradesmen typically carry various tools and accessories that they frequently use when performing a particular project. Various devices and methods have been developed for carrying tools, wherein the tools are attached to a person's belt or otherwise attached on and around the waistband of the person. With any tool holder design, it is desirable that the tool holder enables a person to readily access the tool from the holder, as well as place the tool in/on the tool holder, without undue burden or difficulty. This is especially desirable for tools that are used on a frequent basis, such as tape measures that are used by tradesmen (e.g., carpenters) for measuring anything from cut lumber to tile, etc.

One conventional technique for carrying tools such as tape measures, chalk lines, etc., is to attach a spring clip to the tool casing so that the tool can be clipped to either a person's belt (or other garment part such as pocket) or to a tool holder device. By way of example, FIGS. 1*a* and 1*b* are diagrams illustrating a conventional tape measure (10) having a spring clip device (30). FIG. 1*a* is a perspective front view of a tape measure (10) and FIG. 1*b* is a perspective side view of the tape measure (10). Those of ordinary skill in the art understand the different components and operation of such tape measures.

In general, the exemplary tape measure (10) comprises an outer casing (20) and a contoured, retaining spring clip (30) mounted on a side portion of the tape measure casing (20). The spring clip (30) is typically made of metal and shaped to provide spring-like tension. More specifically, the spring clip (30) comprises a resiliently deflectably tongue portion (31) having an end portion (32). The tongue portion (31) is bent under tension to rest against the casing (20) and is moveable in direction of arrow (as shown in FIG. 1*a*) to permit insertion of some fixed element (belt, etc.) for attachment purposes. As shown in FIG. 1*b*, the tongue portion (31) comprises a slotted portion (33) to permit removal of a fastener (screw) (34) to allow the spring clip (30) to be removed from the casing (20) if desired.

It has been proven to be difficult and inefficient to use spring clips to attach tools to a person's belt. For instance, with the tape measure (10) described above, a person has to unclip and the clip the tape measure to his/her belt each time the tape measure is used. In fact, the person may have to use both hands to clip the tape measure on his/her belt, pocket or other clothing part, especially when the person's belt is worn tight. This can be extremely burdensome, especially when the person is working on a ladder and needs to use one hand to hold the ladder. If the person's belt is worn loose, the tape measure may accidentally unclip from the belt. Also, the frequent use of the spring clip (30) tends to cause excessive wear to the belt or pocket, or other garment part to which the tape measure is attached.

Another conventional method for holding a tape measure having a spring clip is to clip the tape measure on a clipping device that is attached to a tool pouch. For instance, U.S. Patent Application Publication No. US 2002/001457, dated Feb. 7, 2002, by Snider, et al, discloses a tape measure holder that is affixed to outer front pockets of a work belt storage pouch, wherein the holder essentially comprises a clipping portion to which the spring clip of a tape measure is attached. One problem with this tape measure holder design is that the clipping portion is typically not readily accessible and the user must look at the clipping portion to align the spring clip with the clipping portion to attach the tape measure. This can be extremely burdensome, especially when the tape measure is frequently used, or when the person is working on a ladder, or when the person is holding materials or tools with his/her other hand.

Another tape measure holder design is disclosed in U.S. Pat. No. 4,757,927, entitled "Holder for Suspending Rule Clip or the Like". This patent discloses a rectangular holder for suspending a tape measure, wherein the spring clip of a tape measure is clipped to a laterally extending slot that is disposed adjacent a lower edge the rectangular tool holder. Although this design provides improvements over conventional tape measure holders, it does not provide the advantages of the present invention as described below.

Other tool holder designs include pouches, pockets, compartments, etc, for holding tools such as tape measures. For example, U.S. Pat. No. 5,100,037 discloses a leather tape measure holder comprising a leather pouch stowage of a tape measure. The holder comprises a strap member with a snap fastener for securing the tape measure in the pouch. These designs are problematic in that it has been proven to be difficult and burdensome to continuously access and store the tools while working.

Accordingly, more efficient and easier methods for mounting tools such as tape measures are highly desired.

SUMMARY OF THE INVENTION

In general, exemplary embodiments of the invention include tool holders that are designed to hold tools having spring clip mechanisms. More specifically, in one exemplary embodiment of the invention, a tool holder device comprises a guiding portion and a mounting portion. The mounting portion is adapted to engage a spring clip of a tool for mounting the tool. The guiding portion is adapted to guide the spring clip towards the mounting portion as a person slides the tool from the guide portion to the mounting portion while maintaining contact between the spring clip and the guiding portion.

In another exemplary embodiment of the invention, a tool holder device comprises a planar guide plate having tapered edges, wherein a sidewall extends in a direction along each tapered edge, and wherein the sidewalls extend substantially perpendicular from a surface of the planar guide plate. The tool holder further comprises a mounting portion for insertably receiving a spring clip mounted on a tool, wherein the mounting portion is connected to the guide plate at an end portion thereof where the tapered edges converge.

These and other exemplary embodiments, aspects, features and advantages of the present invention will be described or become apparent from die following detailed description of exemplary embodiments, which is to be read in connection with the accompanying drawings.

DETAILED DESCRIPTION OF EXEMPLARY EMBODIMENTS

Figure 1A:
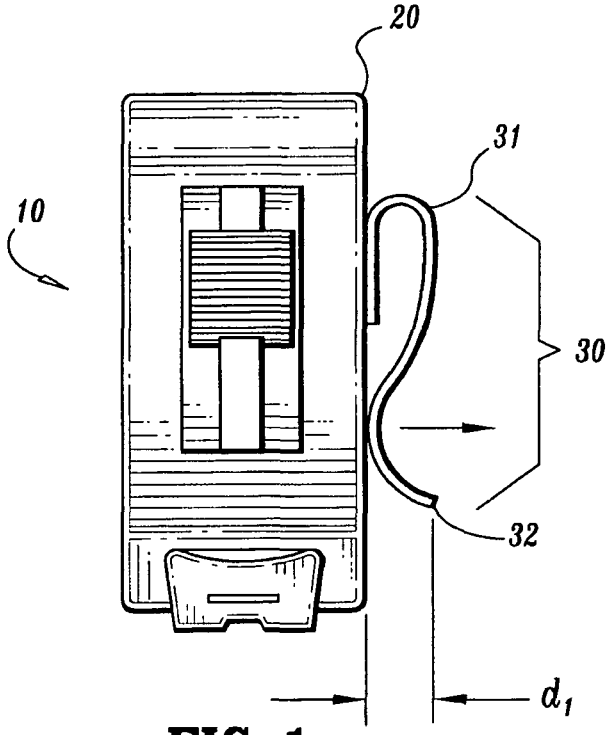
FIG. 1a (Prior Art)
FIGS. 1*a* and 1*b* are schematic diagrams illustrating front and side views, respectively, of a conventional tape measure device having a spring clip mechanism, FIG. 2 schematically depicts a front perspective view of a tool holder according to an exemplary embodiment of the invention.
Figure 1B:
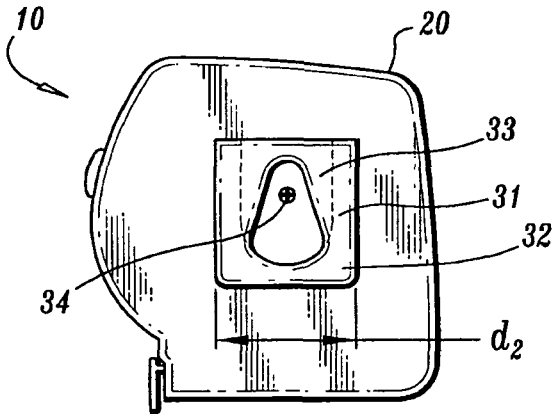
FIG. 1b (Prior Art)

In general, exemplary embodiments of the invention include tool holders that are designed to hold tools having spring clip mechanisms (or similar mechanisms). In particular, exemplary embodiments of the invention include tool holders comprising a guiding plate and mounting plate, wherein the guiding plate enables tools having a spring clip mechanism to be slideably engaged and disengaged from the mounting plate with ease. For illustrative purposes, exemplary embodiments as depicted in FIGS. 2-6 will be described with regard to a tape measure with a spring clip mechanism (such as depicted in FIGS. 1*a* and 1*b*). It is to be understood, however, that the exemplary embodiments described herein are not limited to tape measure holders and that based on the teachings herein, one of ordinary skill in the art will readily appreciate that tool holders according to the invention can be used, or otherwise readily adapted for use, with other tools having spring clip mechanisms (or similar mechanisms).

Figure 2:
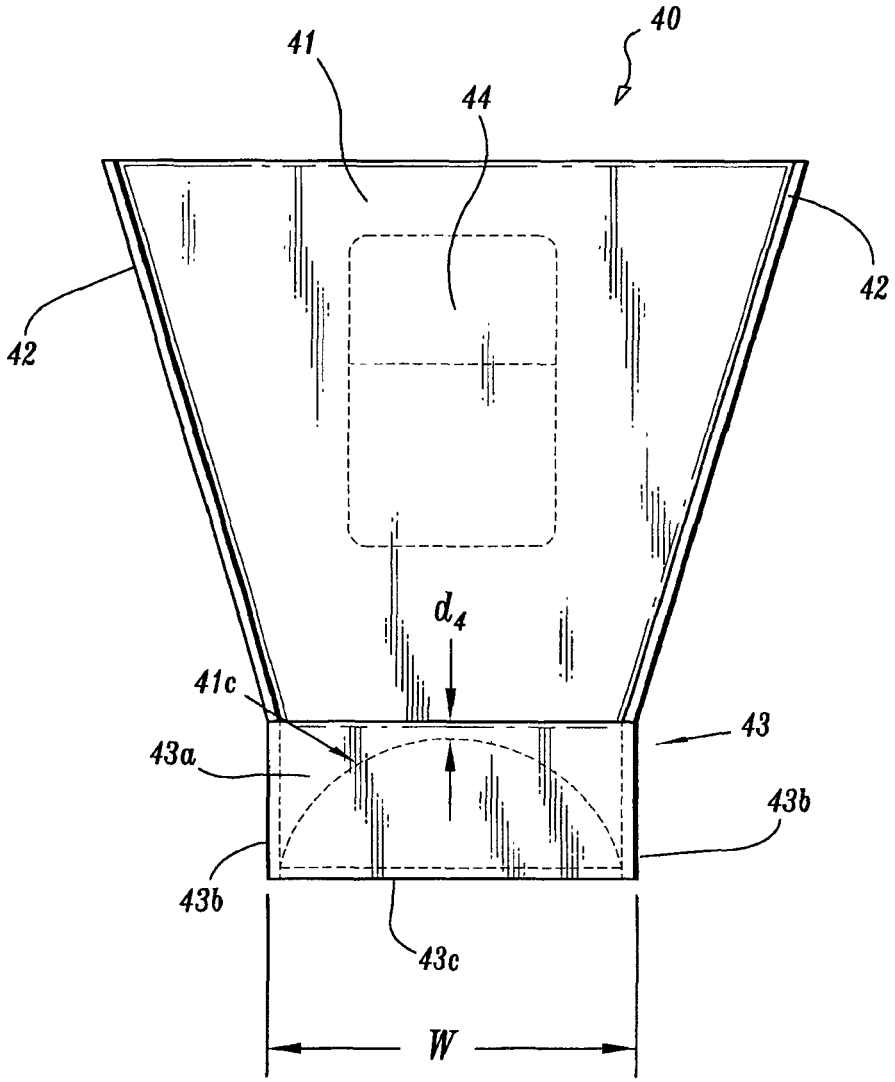
Figure 4:
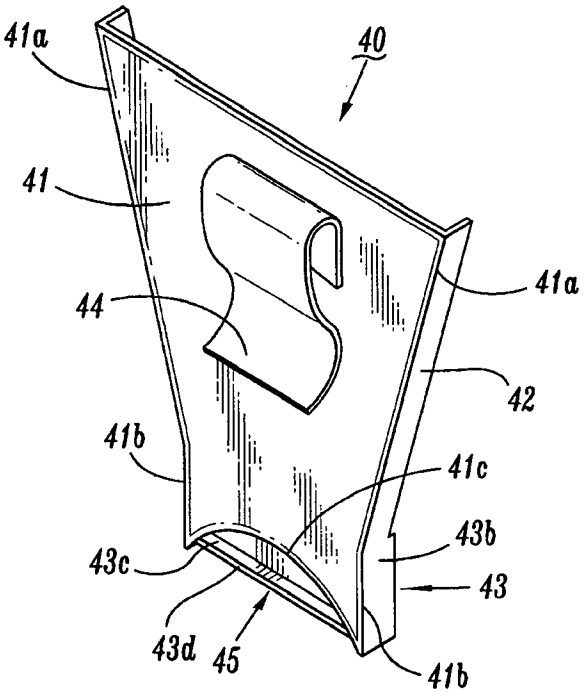
FIGS. 3 and 4 schematically depict isometric views of the exemplary tool holder of FIG. 2.
Figure 3:
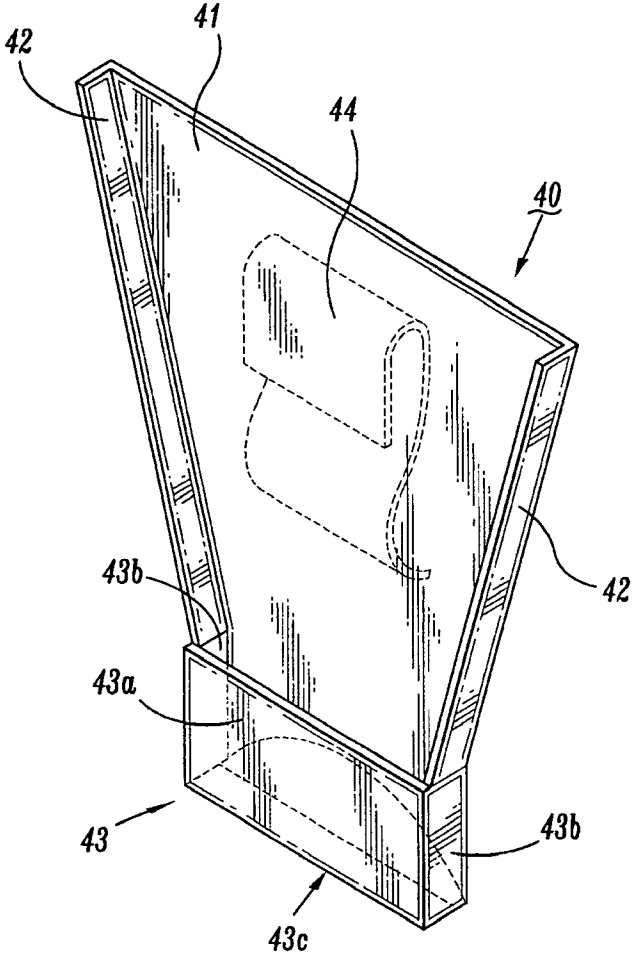

FIGS. 2, 3 and 4 schematically illustrate a tool holder according to an exemplary embodiment of the invention. In particular, FIG. 2 schematically depicts a front perspective view of a tool holder (40) according to an exemplary embodiment of the invention and FIGS. 3 and 4 schematically depict isometric views of the exemplary tool holder (40). In general, the exemplary tool holder (40) comprises a planar guide plate (41) (or "base plate"), sidewalls (42) (or "guiding walls") that extend from a front surface of the guide plate (41), a mounting portion (43), and an attachment device (44) (e.g., spring clip) which is disposed on a back surface of the guide plate (41) (as shown in phantom lines in FIGS. 2 and 3). As explained in further detail below, the guide plate (41) and the sidewalls (42) comprise a guiding portion of the tool holder (40), which enables a tool with a spring clip to be slideably guided to the mounting portion (43) to engage the spring clip of the tool with the mounting portion (43) with relative ease.

In one exemplary embodiment of the invention, as readily depicted in FIG. 4, the planar guide plate (41) is defined, in part, by tapered (upper) side edges (41*a*), substantially parallel (lower) side edges (41*b*), and a curved (bottom) edge (41*c*). The curved bottom edge (41*c*) is depicted in FIGS. 2 and 3 in phantom lines. The sidewalls (42) extend along the tapered side edges (41*a*) of the planar guide plate (41) and extend at an angle of about 90 degrees from the front surface of the planar guide plate (41). The sidewalls (42) converge toward the mounting portion (43) of the tool holder (40).

In general, the mounting portion (43) is designed to, e.g., insertably receive a spring clip of a tool and securely mount the tool on the tool holder (40). The mounting portion (43) comprises a mounting plate (43*a*), side plates (43*b*), and a bottom plate (43*c*) (or "lip portion"). The side plates (43*b*) extend along the (lower) side edges (41*b*) of the guide plate (41) and extend at an angle of about 90 degrees from the front surface of the guide plate (41).

The mounting plate (43*a*) is connected to (or integrally formed with) the side plates (43*b*) such that the planes defined by the mounting plate (43*a*) and guide plate (41) are substantially parallel and such that the inner surface of the mounting plate (43*a*) is offset a certain distance (as explained below) from the front surface of the guide plate (41) to accommodate a spring clip of a tool and securely mount the tool.

The bottom plate (43*c*) operates to offset the spring clip at a certain distance from the outer casing of a tool (when mounted on the tool holder (40)) to thereby generate a spring tension that is sufficient to allow the tool to be securely mounted on the tool holder (40). Further, the tool holder (40) comprises an aperture (45), which (as readily depicted in FIG. 4) is defined, in part, by the curved edge (41*c*) of the guide plate (41) and an edge (43*d*) of the bottom plate (43*c*) of the mounting portion (43). As explained below, the aperture (45) provides an opening that allows a spring clip to protrude from the tool holder (40) as a tool is mounted. The aperture (45) can be optimally sized and shaped to enable a tool to be readily mounted and removed from the tool holder (40).

Figure 6:
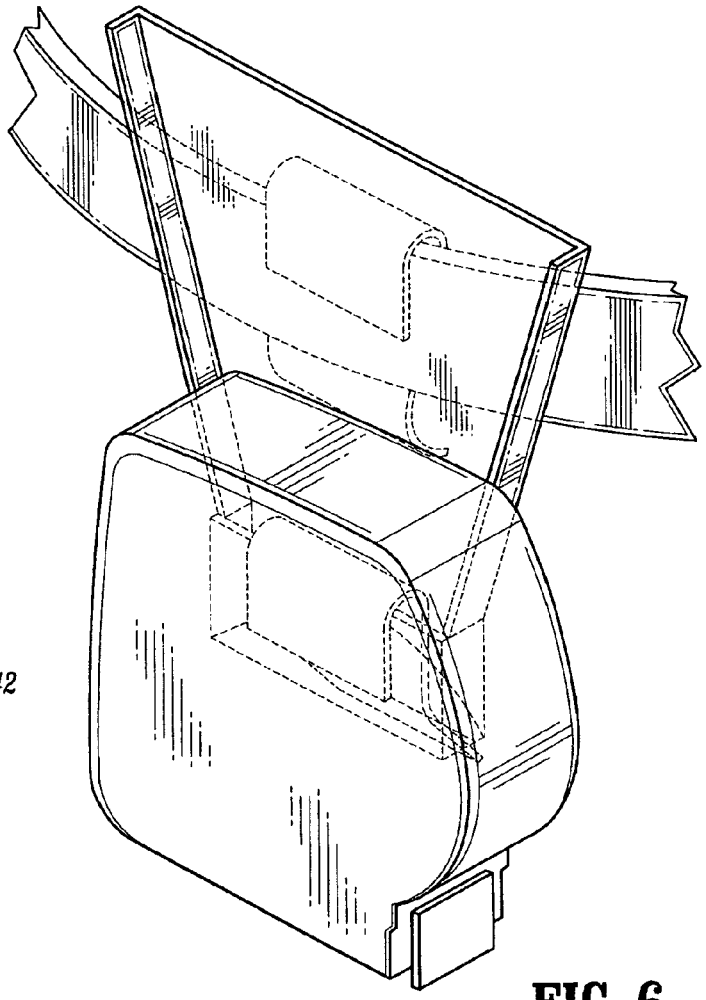
FIG. 6 schematically depicts an isometric view of the exemplary tool holder of FIG. 2 as mounted on a belt and having a tape measure mounted thereon.
Figure 5:
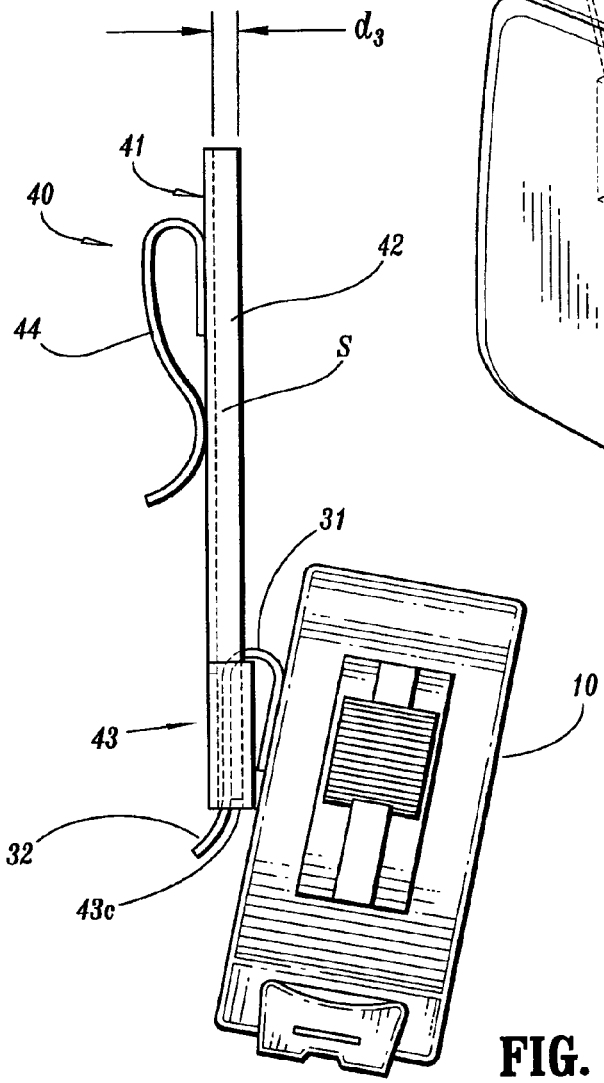
FIG. 5 schematically depicts a side view of the exemplary tool holder of FIG. 2 having a tape measure mounted thereon.

An exemplary method of using the tool holder (40) for mounting a tape measure (such as depicted in FIGS. 1*a* and 1*b*) will now be discussed in detail with further reference to the exemplary embodiments depicted in FIGS. 5 and 6. In particular, FIG. 5 schematically depicts a side view of the exemplary tool holder (40) having a tape measure (10) mounted thereon and FIG. 6 schematically depicts an isometric view of the exemplary tool holder (40) attached to a person's belt and having a tape measure mounted thereon. As noted above, the guide plate (41) and the sidewalls (42) comprise a guiding portion that enables a person to slideably guide the tape measure (10) toward the mounting portion (43) to engage the spring clip (30) with the mounting portion (43).

More specifically, by way of example, to mount the tape measure (10) on the tool holder (40), initially, the person would bring the spring clip (30) of the tape measure (10) in contact with the front surface (S) of the guide plate (41) at some location above the mounting portion (43). Then, the person would slide the tape measure (10) down towards the mounting portion (43) while providing sufficient force to maintain contact between the spring clip (30) (in particular, the end portion (32) of the tongue portion (31)) and the surface (S) of the guide plate (41). As the user slides the tape measure (10) towards the mounting portion (43), if a side edge of the spring clip (30) contacts one of the sidewalls (42), the sidewall (42) will, in effect, "guide" the tape measure (10) towards the mounting portion (43) as the person continues to slide the tape measure down, thereby preventing the tape measure (10) from sliding off a side edge (41*a*) of the guide plate (41).

When the end portion (32) of the spring clip (30) reaches the mounting portion (43), the person will continue to slide the tape measure (10) down such that the tongue portion (31) of the spring clip (30) slides between the guide plate (41) and the mounting plate (43*a*). As the spring clip (30) continues to slideably engage the mounting portion (43), the tongue portion (31) will start to deflect away from its point of contact with the casing (20) due to the mounting plate (43*a*) being inserted between the tongue (31) and casing (20). Due to the aperture (45), this initial deflection, which is essentially equal to the thickness of the mounting plate (43*a*), will not impede the engagement process because the aperture (45) allows the end portion (32) to protrude past a plane defined by the back surface of the guide plate (41).

The tape measure (10) reaches a final mounting position (see FIGS. 5 and 6), when the upper edge of the mounting plate (43*a*) makes contact to the upper round portion of the tongue (31). In the final mounting position, the bottom plate (43*c*) deflects the tongue portion (31) at a distance away from the casing (20) which provides sufficient spring tension to maintain the tape measure securely engaged on the mounting portion (43). Indeed, as depicted in FIG. 5, due to the deflection of the spring clip (30) caused by the bottom plate (43*c*), the casing (20) of the tape measure (10) forcibly contacts the bottom edge of the mounting plate (43*a*), thereby securely mounting the tape measure (10) in the tool holder (40).

Advantageously, the exemplary tool holder (40) enables a person to mount a tool (e.g., tape measure) without having to look at the tool holder (40) as the tool is mounted. Indeed, once contact is made between the guide plate (41) and the tool's spring clip, all the person has to do is maintain sufficient contact between the spring clip the guide plate (41) while sliding the tool down towards the mounting portion (43) and the sidewalls (42) will guide the spring clip to the mounting portion (43) as needed.

It is to be understood that FIGS. 2-6 are schematic diagrams of exemplary tool holders according to the invention, which are not necessarily drawn to scale. It is to be appreciated, however, that optimal sizes and shapes of various components of a tool holder according to the invention can be selected based on, e.g. the type of tool and associated spring clip.

By way of example, optimal dimensions and configuration of components of a tool holder according to an exemplary embodiment of the invention, which is adapted for a conventional tape measure as depicted in FIGS. 1*a* and 1*b*, will now be discussed. It is to be understood, however, that nothing herein shall be construed as placing any limitation on the scope of the invention.

For instance, as shown in FIG. 5, a distance $d_3$, which represents the distance from the front surface (S) of the guide plate (41) to the outer edge of the sidewalls (42), as well as the distance between the front surface (S) of the guide plate (41) and the inner surface of the mounting plate (43*a*), can be selected based on a distance $d_1$ between the end portion (32) of the spring clip tongue (31) and the tape measure casing (20), as shown in FIG. 1*a*. More specifically, in one exemplary embodiment, the distance $d_3$ is approximately equal to or slightly smaller than the distance $d_1$. Indeed, the width $d_3$ is selected such that the bottom portion of the tape measure (10) does not make contact to the mounting portion (43) as the tape measure is slideably engaged into position. Typically, with conventional tape measures, the distance $d_1$ between the end portion (32) and the casing (20) is about 3/16 of an inch. Thus, the width $d_3$ of the sidewalls and mounting portion is preferably about 3/16 of an inch, although it is to be understood that the width $d_3$ may vary depending on the parameters of the tape measure used.

In addition, in one exemplary embodiment, the width W of the mounting portion (43) (as shown in FIG. 2) is preferably selected to be slightly greater than the width $d_2$ of the spring clip (30) (as shown in FIG. 1*b*) so that the tape measure is tightly secured. Typically, with conventional tape measures, the width $d_2$ of the spring clip is about 1.25 inches, although it is to be understood that the width $d_2$ may vary depending on the parameters of the tape measure used. In such embodiment, the width W is about 1.75 inches.

Furthermore, in one exemplary embodiment, the size and shape of the aperture (45) can be optimized for a given spring clip configuration, to enable smooth sliding engagement/disengagement of the spring clip to/from the mounting portion (43). In particular, in one exemplary embodiment as depicted in FIG. 2, the aperture (45) is defined by a bottom curved edge (41*c*) of the guide plate. As noted above, as the spring clip (30) slideably engages die mounting plate (43*a*), the tongue portion (31) starts to deflect away from its point of contact with the casing (20) due to the mounting plate (43*a*) being inserted between the tongue (31) and casing (20). The aperture (45) enables the end portion (32) to protrude therefrom, thereby preventing the engagement process from being impeded due to, e.g., the end portion (32) being pressed against the surface (S) of the guide plate (41) as the spring clip starts to deflect.

Furthermore, although the aperture (45) of the exemplary tool holder (40) is depicted as being defined by the curved edge (41*c*), it is to be understood that the aperture (45) can be any suitable shape such as rectangular.

It is to be appreciated that a tool holder according to the invention (such as the exemplary tool holder (40) discussed above) may be made of any rigid material such as stainless steel, aluminum or plastic, or any other rigid material that is durable and provides a low friction surface to slideably contact the spring clip of a tool.

Furthermore, various methods may be used for constructing a tool holder according to the invention, depending on the material used. For example, in the exemplary tool holder (40) described above, the guide plate (41) and sidewalls (42) can be integrally formed with stainless steel or aluminum for example, whereby the sidewalls (42) are formed by bending the tapered edges of a rigid plate, or whereby the sidewalls (42) are welded or otherwise connected to the tapered side edges (41*a*) of the guide plate (41). In addition, if plastic is used, the tape measure holder (40) can be formed by injection molding, for example. One of ordinary skill in the art can readily envision other methods for building a tape measure holder according to the invention.

Further, a tool holder according to die invention may comprise any suitable mechanism for securing the tool holder to a person's belt, pocket or other garment. For instance, the exemplary tool holder (40) described above includes a spring clip (44) mounted on the back thereof to attach to a person's belt or pocket. It is to be understood, however, that a tool holder according to the invention may comprise any suitable attachment mechanism, such as slots form on a back surface thereof for insertably receiving a belt. In addition, a tool holder according to the invention may be mounted directly on a leather tool belt, for instance.

Figure 7A:
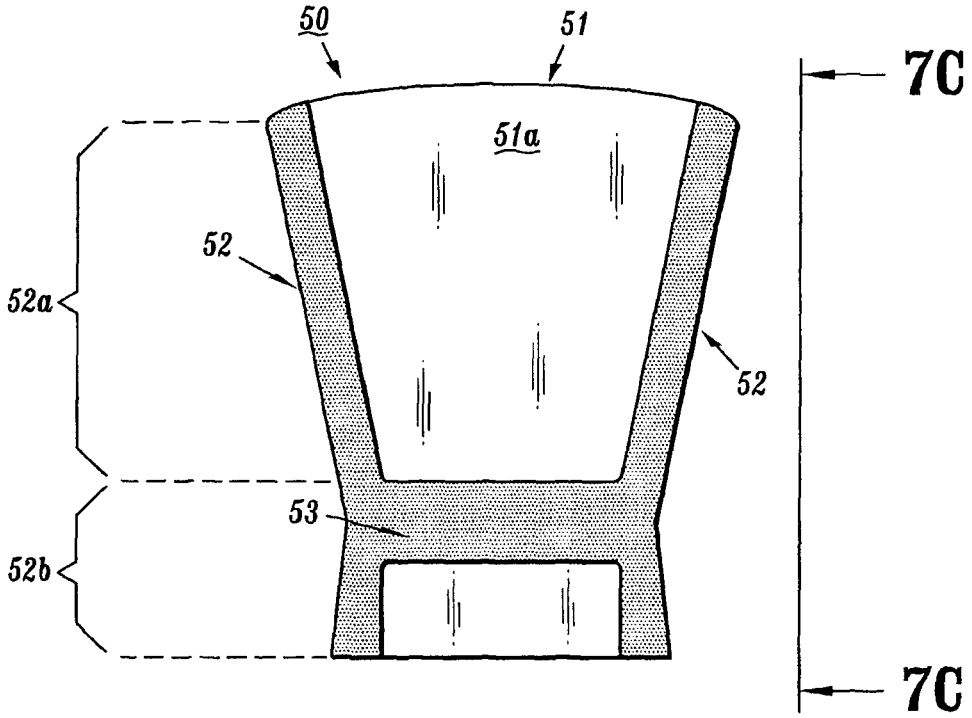
FIGS. 7A, 7B and 7C are schematic front, back and side views, respectively, of a tool holder according to another exemplary embodiment of the invention.
Figure 7B:
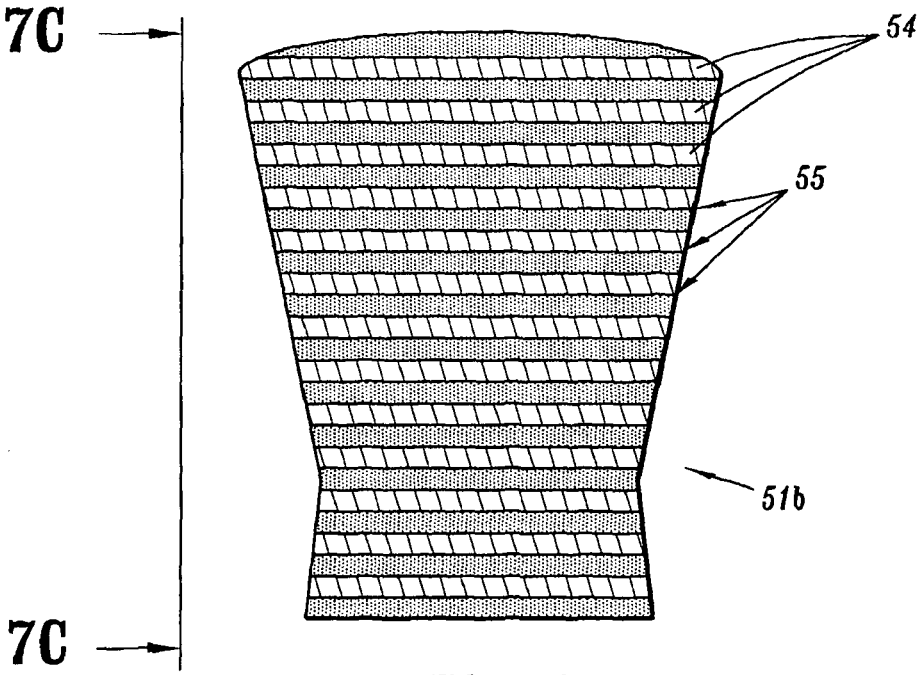
Figure 7C:
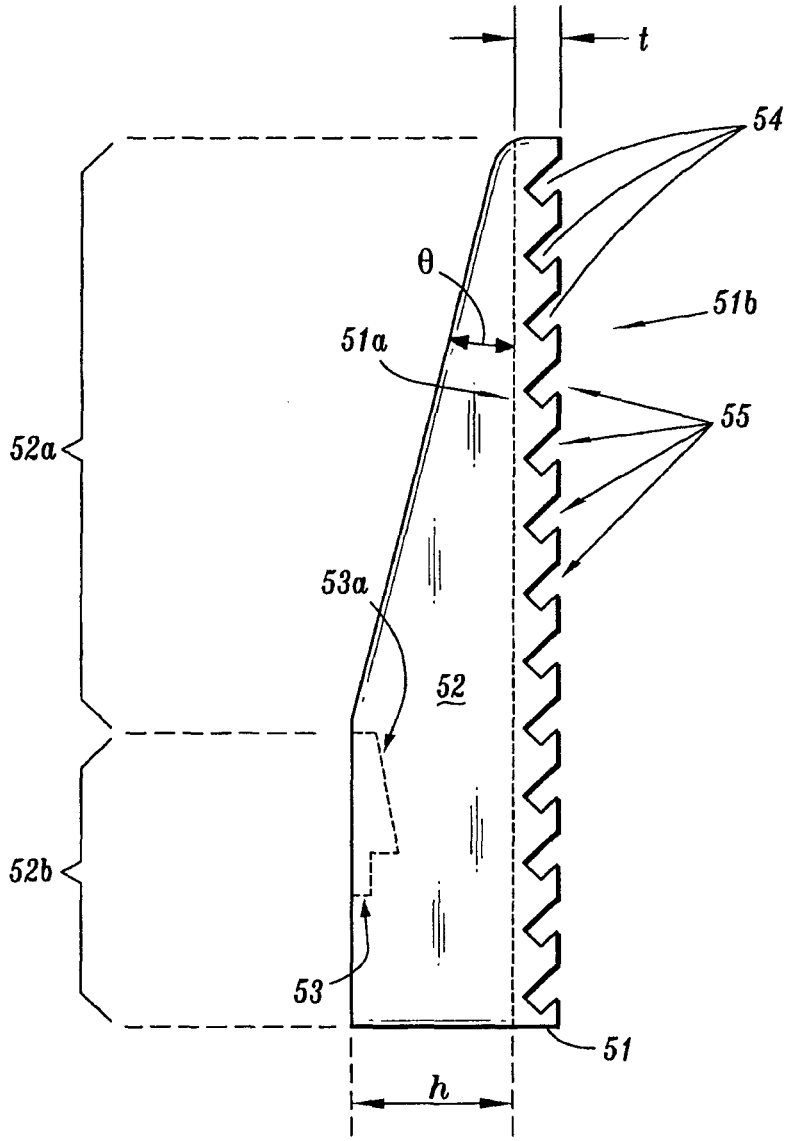

FIGS. 7A, 7B and 7C are schematic front, back and side views, respectively, of a tool holder (50) according to another exemplary embodiment of the invention. In particular, FIG. 7A schematically depicts a front perspective view of a tool holder (50) comprising a planar guide plate (51) (or "base plate"), sidewalls (52) (or "guiding walls") that extend at, e.g., a right angle, from a front surface (51*a*) of the guide plate (51), and a mounting portion (53). FIG. 7B is backside perspective view of the tool holder (50) showing a back surface (51*b*) of the planar guide plate (51). FIG. 7C is a side view of the tool holder (50) as viewed along lines 7C-7C in FIGS. 7A and 7B.

In the exemplary embodiment, an upper portion of the planar guide plate (51) has tapered edges wherein an upper portion (52*a*) of the sidewalls (52) extend along the tapered side edges of the planar guide plate (51) and converge toward the mounting plate (53) of the tool holder (50). The mounting plate (53) is designed to, e.g., insertably receive a spring clip of a tool and securely mount the tool on the tool holder (50). The mounting plate (53) is disposed between the lower portions (52*b*) of the opposing sidewalls (52). In FIG. 7A, the mounting plate (53) is shown to extend a portion of the length of the lower portions (52*b*) of the sidewalls (52), although this is merely optional and the mounting plate (53) can extend along the entire length of the bottom portions (52*b*) of the sidewalls (52).

As shown in FIG. 7C, the upper portions (52*a*) of the sidewalls (52) have a sloping upper surface that extends at an angle θ from the top surface (51*a*) of the plate (51) toward the mounting portion (53). The upper surface of the lower portion (52*b*) of the sidewall (52) is substantially parallel to the front surface (51*a*) of plate (51) and is offset at a height h from the plate surface (51*a*). The mounting portion (53) includes an angled lipped portion (53*a*) disposed on the inner surface of the mounting plate (53). The lipped portion (53*a*) extends at an angle from the top of the mounting plate (53) to a predetermined point before a bottom edge of the page (53). In the exemplary embodiment of FIG. 7C, the offset distance h from the mounting plate (53) allows from the plate surface (51*a*) serves various purposes. For example, this offset distance h allows the The mounting plate (53) and lipped portion (53*a*) operates to secure the tool without keeping a spring clip under tension when mounted.

An exemplary method of using the tool holder (50) for mounting a tape measure (such as depicted in FIGS. 1*a* and 1*b*) will now be discussed in detail with farther reference to the exemplary embodiments depicted FIG. 8, which schematically depicts a side view of the exemplary tool holder (50) of FIG. 7C having a tape measure (10) mounted thereon. The guide plate (51) and the sidewalls (52) comprise a guiding portion that enables a person to slideably guide the tape measure (10) toward the mounting portion (53) to engage the spring clip (30) with the mounting portion (53). For example, to mount the tape measure (10) on the tool holder (50), initially, the person would place the back of the tape measure (10) with the casing (20) in contact with the front surface (51*a*) of the guide plate (51) at some location above the mounting portion (53). Depending on where the tape measure (10) is initially placed, the spring clip (30) may or may not be in contact with surface (51*a*). With the sloping sidewall portions (52*a*), the back of the tape measure (10) casing would come in contact with the upper surface of the sidewalls (52) as the person slides the tape measure (10) down towards the mounting portion (53) while providing sufficient force to maintain contact between the tool (10) and sloped surface of the sidewall portions (52*a*). As the user slides the tape measure (10) towards the mounting portion (53), if a side edge of the spring clip (30) contacts one of the sidewalls (52), the sidewall (52) will, in effect, "guide" the tape measure (10) towards the mounting portion (53) as the person continues to slide the tape measure down, thereby preventing the tape measure (10) from sliding off a side edge of the guide plate (51)

When the end portion (32) of the spring clip (30) reaches the mounting portion (53), the person will continue to slide the tape measure (10) down such that the tongue portion (31) of the spring clip (30) slides between the guide plate (41) and the mounting plate (53). As the spring clip (30) continues to slideably engage the mounting portion (53), the tongue portion (31) will start to deflect away from its point of contact with the casing (20) due to the mounting plate (53) being inserted between the tongue (31) and casing (20). Because of the offset distance h, this initial deflection will not be impeded by contact with the surface (51*a*) of the plate (51).

Figure 8:
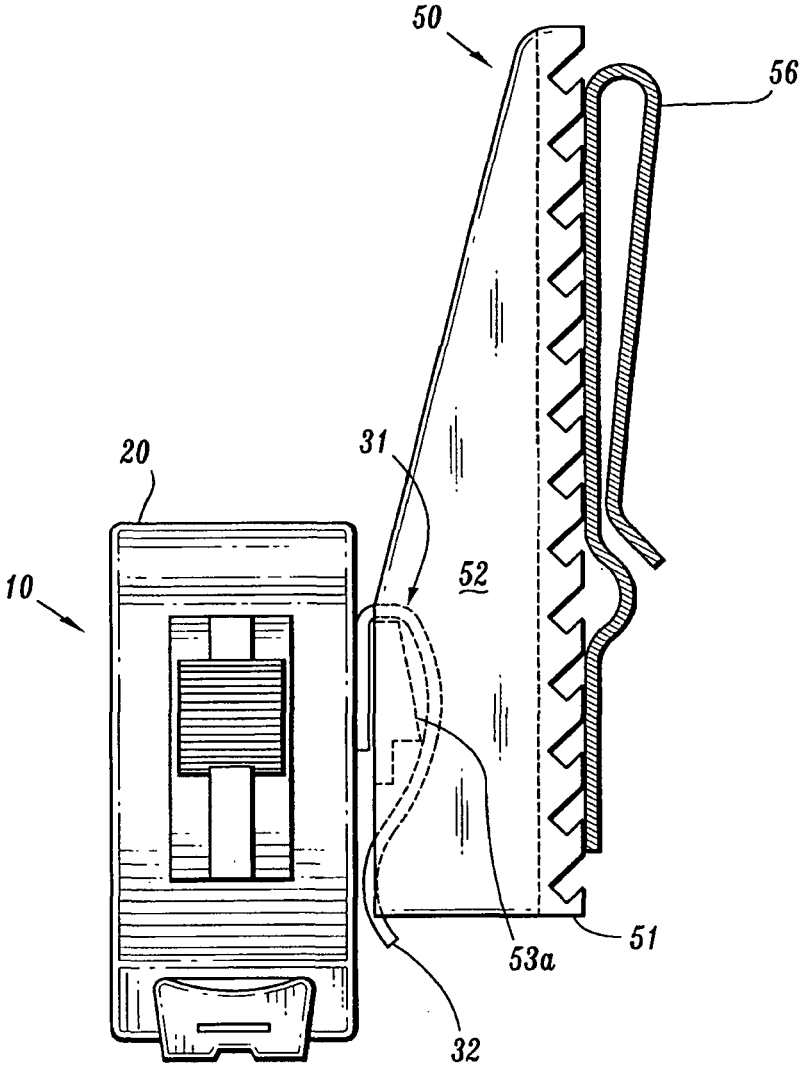
FIG. 8 schematically depicts a side view of the exemplary tool holder of FIG. 7C having a spring clip mounting mechanism mounted on a back side of the device and a tape measure mounted on a front side of the device.

When the tape measure (10) reaches a final mounting position in FIG. 8), the tongue (31) rests on the top edge of the mounting plate (53) and wraps around a portion of the lipped portion (53*a*) of the plate (53). In the final mounting position, the spring clip is not in spring tension, but rather in a non-flexed, normal state. The tape measure is securely engaged on the mounting portion (53) with the casing in contact with the flat surfaces of the mounting plate (53) and sidewall portions (52*a*) and the tongue (31) in contact with the bottom edge of the angled lipped portion (53*a*).

Advantageously, the exemplary tool holder (50) enables a person to mount a tool (e.g., tape measure) without having to look at the tool holder (50) as the tool is mounted. Indeed, once contact is made between the surface of sidewalls (52) and the casing (20) or contact of the spring clip to the surface (51*a*) of guide plate (51)*p*, all the person has to do is maintain sufficient force against the holder (50) while sliding the tool down towards the mounting portion (53) and the sidewalls (52) will guide the spring clip to the mounting portion (53) as needed.

In another exemplary embodiment of the invention, the tool holder (50) the back surface (51*b*) of the tool holder (50) may have some friction means that would serve to counteract pulling forces applied to the tool (50) when disengaging a tool from the tool holder (50) and prevent the tool holder (50) from being pulled along with the tool. For example, in one exemplary embodiment depicted in FIGS. 7B and 7C, the back surface (51*b*) of the plate (51) may have a plurality of angled channels (54) formed therein which extend longitudinally between side edges of the plate (51). IN this embodiment, the back surface (51*b*) would comprises a plurality of surface segments (55) having pointed edges over the entire or portion of the back surface (51*b*) of the plate (51). IN this embodiment, the plate (51) would have a thickness t sufficient to form angled channels (54) Without penetrating to the front surface (51*a*) and maintaining sufficient rigidity of the plate (51). As shown in FIG. 8, a narrow spring clip (56) can be mounted on a central region of the back surface (51*b*) of the plate (51) and used to mount the tool holder (50) to a person's belt or pants. When a person proceeds to disengage the tool from the tool holder (50), the force applied to the tool (10) against the holder (50) in a direction normal (perpendicular) to the plane of the plate (51) would serve to press the sharp ridged segments (55) on the back of the plate (51) into the surface (e.g., pants) in contact with the back surface (51*b*) of the tool holder (50) and prevent the tool holder (50) from slipping upward as the tool is pulled up to disengage from the mounting plate (53).

In FIGS. 7B and 7C, the ridged back surface (51*b*) is one exemplary embodiment where the ridged surface is integrally formed as part of the back surface (51*b*). The tool holder (50) can be fabricated from a block of plastic material using known methods, where the angled channels (54) are routed into the back surface (51*b*). In other embodiments, a friction surface can be a separately formed element that is mounted to the back surface (51*b*) of the plate. The friction surface can have any suitable framework that is suitable for the stated purpose.

It is to be appreciated that a tool holder according to the invention may be designed and fabricated to hold not only tape measures, but other tools having a similar configuration with a flexible spring clips attached thereto such as snap lines, etc. It is to be further appreciated that from the standpoint of a manufacturer, a tool holder according to the invention is relatively easy and inexpensive to manufacture and is cost effective from the standpoint of the user.

Although illustrative embodiments have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A tool holder device, comprising:

a planar base plate having first and second opposing surfaces, the base plate comprising tapered side edges with a sidewall that extends along each tapered edge of the planar base plate, and wherein the sidewalls extend substantially perpendicular from the first surface of the planar base plate; and a mounting plate for insertably receiving a spring clip mounted on a tool, the mounting plate being disposed at an end portion of the base plate where the tapered edges converge, wherein the sidewalls are configured to slideably engage and guide the spring clip of the tool in a direction towards the mounting plate as a user slides the tool along the tool holder device towards the mounting plate to spring clip mount the tool to the tool holder device, wherein the mounting plate is disposed parallel with the planar base plate, wherein the planar mounting plate is offset from the first surface of the planar base plate by an offset distance to insertably receive a spring clip therebetween, and wherein the mounting plate comprises a lipped portion formed on an inner surface of the mounting plate facing the first surface of the base plate, to thereby cause the spring clip of the tool to resiliently deflect when engaging with the mounting plate.

2. The device of claim 1, wherein the lipped portion maintains the tool spring clip in tension when the tool is mounted on the mounting plate.

3. The device of claim 1, wherein the lipped portion maintains the tool spring clip in non-tension when the tool is mounted on the mounting plate.

4. The device of claim 1, wherein a first portion of each sidewall has a sloping upper surface that extends at an angle from the first surface of the planar base plate toward the mounting plate, and wherein a second portion of each sidewall has a non-sloping upper surface that is substantially parallel to the first surface of planar base plate and offset at a height h from the first surface of the planar base plate.

5. The device of claim 4, wherein the mounting plate is disposed between opposing second portions of the sidewalls.

6. The device of claim 5, wherein the mounting plate is disposed between a portion of a length of the second portions of the sidewalls.

7. The device of claim 1, wherein the second surface of the base plate comprises friction means to engage a surface in contact with the back of the tool holder and provide an opposing force to counteract pulling forces when a tool is disengaged from the tool holder.

8. The device of claim 7, wherein the friction means comprises a plurality of longitudinal surface segments having pointed edges that extend in a direction between side edges of the planar base plate.

9. The device of claim 8, wherein the surface segments are integrally formed as part of the base plate by routing angled channels into the material forming the base plate.

10. The device of claim 1, wherein the device is formed of plastic.

11. The device of claim 1, further comprising a mounting device for mounting the tool holder device to a belt.

12. The device of claim 11, wherein the mounting device comprises at least one spring clip mounted to the second surface of the planar guide plate.

13. The device of claim 1, wherein an upper surface of each sidewall is substantially parallel to the first surface of the base plate along the tapered side edges of the planar base plate toward the mounting plate.

14. The device of claim 13, wherein the tool holder device is a tape measure holder device.

15. A tool holder device, comprising:

a planar base plate having first and second opposing surfaces, the base plate comprising tapered side edges with a sidewall that extends along each tapered edge of the planar base plate, and wherein the sidewalls extend substantially perpendicular from the first surface of the planar base plate; and a mounting plate for insertably receiving a spring clip mounted on a tool, the mounting plate being disposed at an end portion of the base plate where the tapered edges converge, wherein a first portion of each sidewall has a sloping upper surface that extends at an angle from the first surface of the planar base plate toward the mounting plate, and wherein a second portion of each sidewall has a non-sloping upper surface that is substantially parallel to the first surface of planar base plate and offset at a height h from the first surface of the planar base plate, and wherein the mounting plate is disposed between opposing second portions of the sidewalls.

* * * * *